United States Patent [19]

Davis

[11] 4,310,072

[45] Jan. 12, 1982

[54] FLUID LINE COUPLING FOR FLUID ACTUATED EXTENSIBLE STRUCTURE

[75] Inventor: Dean E. Davis, Battle Creek, Mich.

[73] Assignee: Clark Equipment Company, Buchanan, Mich.

[21] Appl. No.: 104,503

[22] Filed: Dec. 17, 1979

[51] Int. Cl.[3] ..... B66B 9/20

[52] U.S. Cl. ..... 187/9 R; 91/189 R; 137/614.04

[58] Field of Search ..... 187/9 R, 9 E; 91/167, 91/168, 432, 189 R; 92/146; 137/614, 614.01, 614.02, 614.04; 251/149.7, 149.1; 414/629, 641

[56] References Cited

U.S. PATENT DOCUMENTS

| | | | |
|---|---|---|---|
| 2,638,915 | 5/1953 | Mitchell | 137/614.04 |
| 2,693,835 | 11/1954 | Lundell | 251/149.7 |
| 2,855,071 | 10/1958 | Arnot | 187/9 R |
| 2,926,934 | 3/1960 | Gill | 137/614.04 |
| 2,966,371 | 12/1960 | Bruning | 137/614.04 |
| 3,028,328 | 4/1962 | Tengsater | 251/149.7 |
| 3,188,917 | 6/1965 | Quayle | 91/168 |
| 3,247,768 | 4/1966 | Tennis | 91/189 R |
| 3,394,778 | 7/1968 | Brinton | 187/9 R |
| 3,508,580 | 4/1970 | Snyder, Jr. | 137/614.04 |
| 3,658,189 | 4/1972 | Brown et al. | 91/168 |

*Primary Examiner*—Robert J. Spar
*Assistant Examiner*—Kenneth Noland
*Attorney, Agent, or Firm*—Mack L. Thomas

[57] ABSTRACT

A lift truck having a particular type of upright, namely, a triple stage upright having a fixed upright section, two telescopic sections, and a load carrier mounted on the inner telescopic section. A primary lift cylinder and chain assembly is mounted from and elevatable with the inner upright section and is connected with the load carrier to elevate it with the inner section, and a secondary lift cylinder is supported from the truck and connected to elevate the telescopic sections with the primary cylinder and load carrier. A fluid conduit is provided between the primary lift cylinder and secondary lift cylinder, a first portion of the fluid conduit having a first valve interposed therein is operatively associated with the primary lift cylinder and is selectively engageable with a second valve interposed in a second portion of the fluid conduit and operatively connected with the secondary lift cylinder. When the primary lift cylinder is retracted relative to the secondary lift cylinder, the coupling comprised by the first and second valves is in its fluid engagement position, but is not in its fluid engagement position when the primary lift cylinder is extended. The coupling has self-centering alignment capability. Fluid retained in the second valve is protected from contamination by an overlying cover plate when the primary lift cylinder is extended.

16 Claims, 7 Drawing Figures

FLUID LINE COUPLING FOR FLUID ACTUATED EXTENSIBLE STRUCTURE

BACKGROUND OF THE INVENTION

1. Field of the Invention

The invention relates to fluid couplings for fluid actuated extensible structure and more specifically to a hydraulic coupling in a hydraulic line of a lift truck upright.

2. Description of the Prior Art

Over the years a persistent problem in fluid actuated extensible structures, such as multi-stage uprights for lift trucks, has been to provide a construction which affords the operator of the apparatus good visibility through the structure. Heretofore, various means have been devised for improving operator visibility through lift truck uprights such as is disclosed in U.S. Pat. Nos. 2,855,071, 3,213,967, 3,394,778, U.S. Pat. No. Re. 27,731, and in copending U.S. Application Ser. No. 017,779, filed Mar. 8, 1979 now abandoned, all of which are assigned to the assignee of the present application.

Generally, in the above-discussed prior art, as shown in FIG. 8 of Application Ser. No. 017,779, supra, fluid communication between a primary cylinder and a secondary cylinder is provided by a hose that is routed from the base of the secondary cylinder to the top of the upright, over a sheave and then back down to the base of the primary cylinder.

Frequently the design of the upright dictates that the hose routed over the sheave at the top of the upright must bend below the minimum recommended bend radius which leads to shortened hose life. To minimize the bend radius the hose diameter can be reduced but this creates increased back pressure and adds inefficiency to the hydraulic system. Additionally, the above-described hose connection reduces visibility through the upright.

SUMMARY OF THE INVENTION

This invention solves the above-mentioned problems by providing a hydraulic coupling which includes a first valve mounted on a telescopic section and a second valve mounted on a relatively fixed section. The valves engage when a secondary hydraulic cylinder assembly is retracted longitudinally of the fixed section to cause the primary hydraulic cylinder assembly to be retracted relative to the secondary hydraulic cylinder assembly. The valves are disengaged when the secondary hydraulic cylinder assembly is extended longitudinally of said fixed section.

The first valve of the coupling has a tapered outer end to assist registration with the second valve when the secondary hydraulic cylinder assembly is retracted longitudinally of the fixed section. Additionally, the second valve is flexibly mounted on the fixed section and is internally tapered to assist coupling registration.

It is a primary object of this invention to improve operator visibility through a fluid actuated extensible structure. Other objects, features and advantages of the invention will readily appear to persons skilled in the art from the detailed description of the invention which follows.

DETAILED DESCRIPTION OF THE PREFERRED EMBODIMENT

The upright of the present invention is for use with any suitable lift truck (not shown). The invention is, however, broader than any application disclosed herein, it being applicable to any type or model of lift truck upright, two stage, triple or quad, for example, or to such devices as telescopic hydraulic crane equipment, or to any other mechanism wherein the fluid line coupling of my invention is applicable to permit separation of a fluid conduit which connects different hydraulic actuators when one actuator is actuated outwardly of a second actuator. One preferred embodiment of the present invention is shown in FIGS. 2–6 for an asymmetric triple stage upright which is described in detail in application Ser. No. 017,779, supra.

Figure 1:
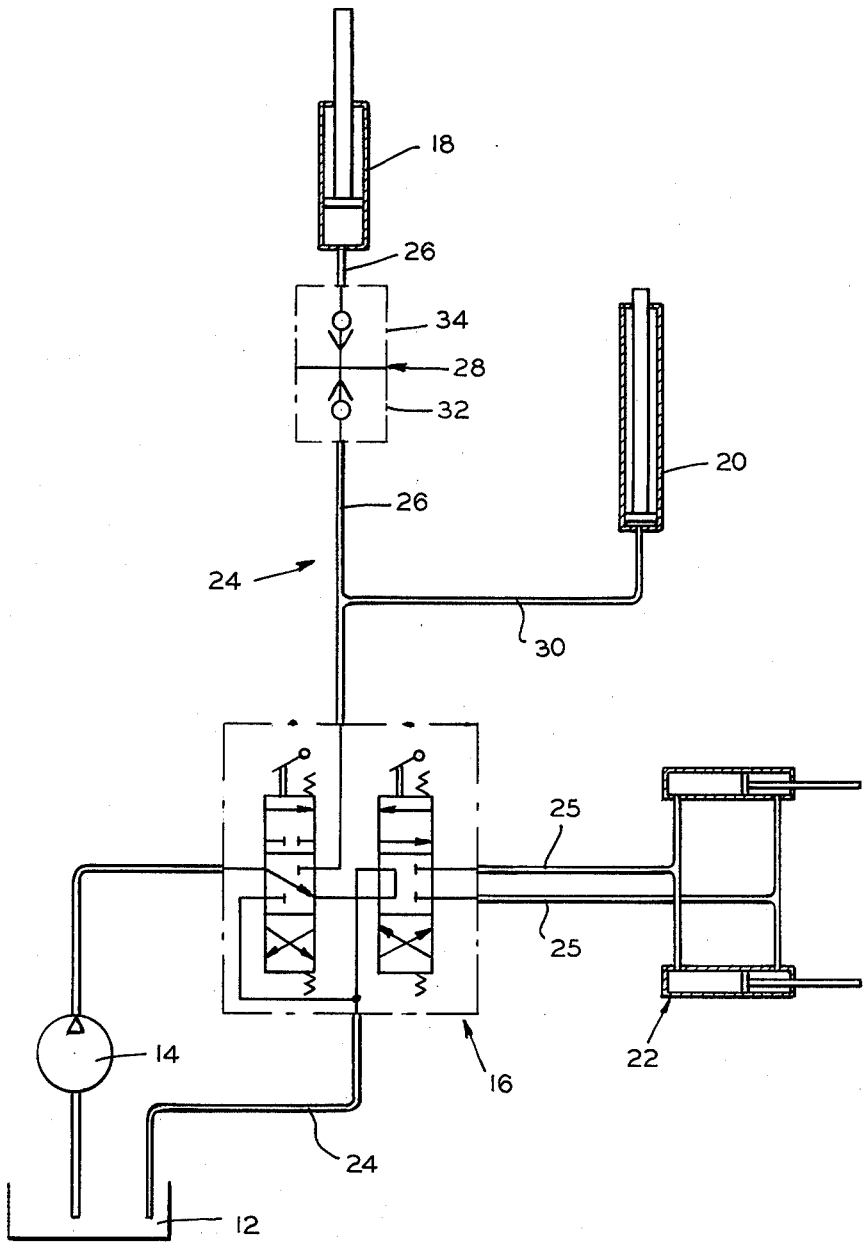
FIG. 1 is a schematic view of the hydraulic circuitry of the present invention.

The hydraulic circuitry for the present invention is shown schematically in FIG. 1. Hydraulic fluid is supplied from a fluid reservoir 12 through a suitable pump 14 and then through a control valve 16 to the primary and secondary lift cylinders 18 and 20 respectively, and to other hydraulically controlled functions such as upright tilt cylinders 22. A hydraulic conduit means 24 is adapted to connect primary and secondary cylinders 18 and 20 to fluid reservoir 12 through control valve 16 while conduit means 25 connects cylinders 22 to reservoir 12 through control valve 16. Branches 26 and 30 of conduit means 24 connect primary and secondary lift cylinders 18 and 20 respectively, to control valve 16 and to reservoir 12. A coupling 28 including a first valve assembly 34 and a second valve assembly 32 is interposed in branch conduit 26. Valve 34 is in fluid flow engagement with valve 32 when secondary cylinder 20 is in the retracted position shown in FIG. 1.

Referring now to FIGS. 2–7, the triple stage upright assembly 40 comprises a fixed mast section 42 which includes a pair of transversely spaced opposed channel members 44 arranged to receive an intermediate telescopic mast section 46 formed of two laterally spaced I-beams 48, mast section 46 being guide roller supported in mast section 42 and arranged for longitudinal movement relative thereto. An inner mast section 50 formed of two laterally spaced I-beams 52 is similarly guide roller supported in mast section 46 and arranged for longitudinal movement relative thereto. A load or fork carriage 54 having a pair of transverse support plates 56 and 58 is guide roller mounted for elevation in the inner upright section 50, all in known manner.

Mast section 42 is cross-braced for rigidity by means of upper and lower transverse brace members 60 and 62, intermediate telescopic section 46 is cross-braced by upper and lower transverse members 64 and 66, and inner section 50 is cross-braced by upper, intermediate and lower transverse members 68, 70, 71, 72, and 74, members 70 and 72 also serving to support the primary lift cylinder, as will be explained.

The I-beam mast section 46 is nested within the outer section 42 in known manner such that the forward flanges of the I-beams 48 are disposed outside of and overlapping the forward flanges of channels 44, and the rear flanges of the I-beams are disposed inside the adjacent channel portions and forwardly of the rear flanges of channels 44, pairs of rollers 80 being suitably mounted between said adjacent pairs of the I-beams and channels for supporting the I-beam telescopic section longitudinally and laterally for extensible movement relative to the fixed channel section. In a similar manner, inner I-beam mast section 50 is nested within intermediate section 46 for extensible movement relative to the intermediate I-beam section.

Figure 2:
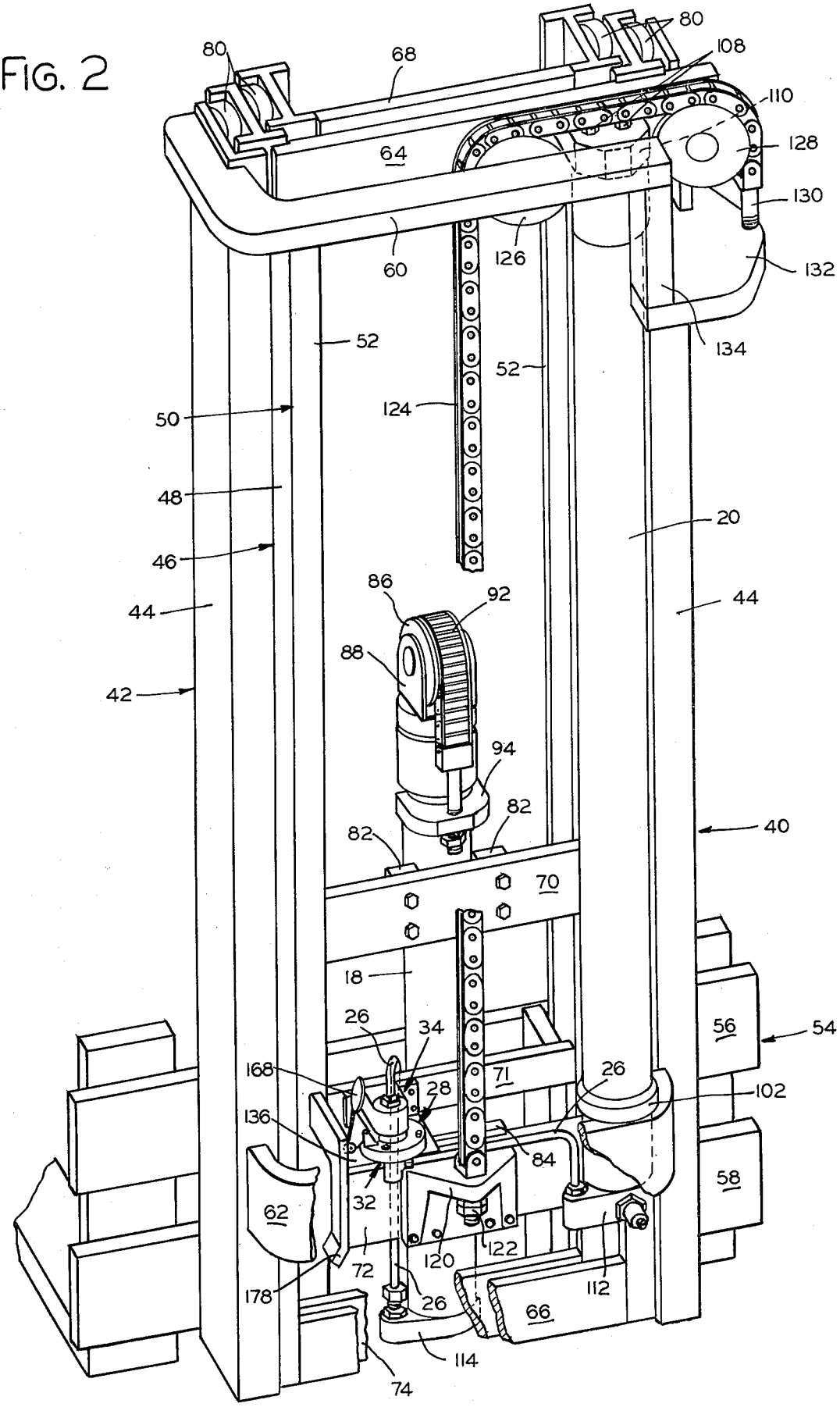
FIG. 2 is a perspective view of an upright embodying the present invention with parts broken away to reveal details of construction.
Figure 3:
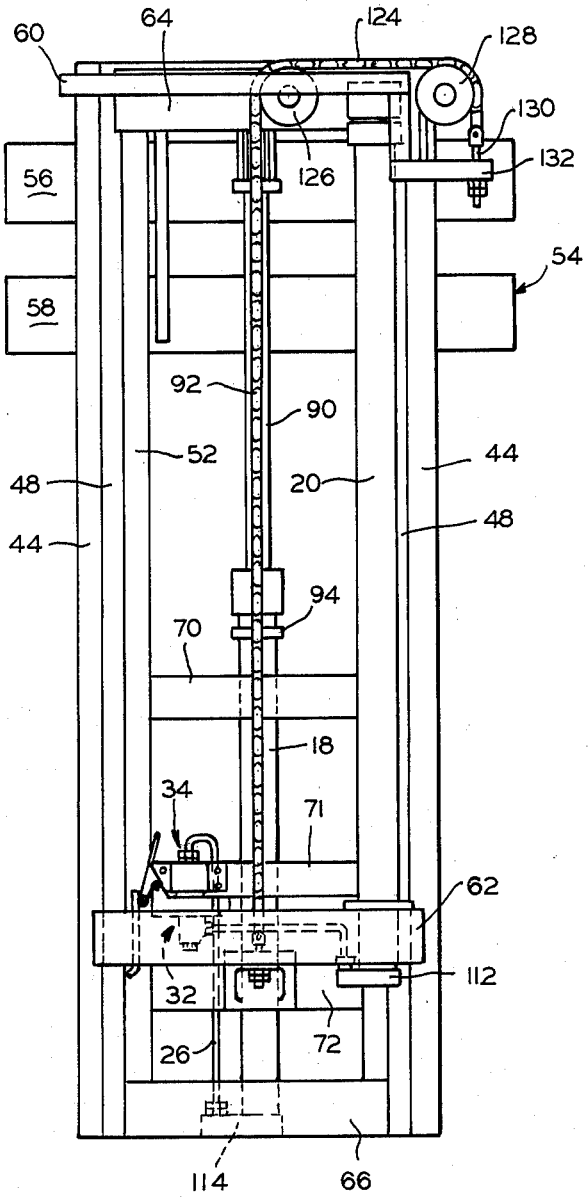
FIG. 3 is a rear elevational view of the upright of FIG. 2 shown in a free-lift position.

A first fluid actuator assembly includes a primary lift cylinder 18 supported centrally of inner upright section 50 on brace members 70 and 72 by brackets 82 and 84 secured, as by welding to the cylinder and secured by studs to the transverse members 70 and 72 (FIG. 2). A single sprocket 86 is mounted for rotation by a bracket 88 at the end of a piston rod 90, a lifting chain 92 being reeved on the sprocket and secured at one end to an anchor plate 94 located on the cylinder, and which at the opposite end is secured centrally of carriage plate 58 by an anchor block (not shown). A junction block 114 is located at the bottom of the primary cylinder 18 for conveying hydraulic fluid to and from the primary cylinder 18 by branch conduit 26. Lift cylinder 18 is substantially one-half the length of the inner upright section 50 and when extended actuates the fork carriage at a 2:1 ratio to a full free-lift position as shown in FIG. 3 prior to the elevation of intermediate and inner upright sections 46 and 50 by a secondary asymmetric hydraulic lift cylinder assembly 20 shown in a position of partial extension in FIG. 4.

A secondary fluid actuator assembly includes secondary lift cylinder 20 supported near the bottom from brace member 62 by a collar 102 welded to the cylinder, the piston rod 104 being secured by a pair of studs 108 to a block member 110 which is welded to the rear surface of brace member 64, thus supporting the cylinder assembly from the top and bottom portions. A junction block 112 is located at the bottom of the cylinder for conveying hydraulic fluid to and from the cylinder through branch conduit 30.

A chain anchor block 120 is secured centrally of inner upright transverse brace member 72 at an anchor connection 122 of a secondary lifting chain 124 which extends upwardly and over a pair of transversely spaced sprockets 126 and 128, and then downwardly to a fixed anchor connection 130 located in a predetermined position adjacent the outer end of a step-down support and brace plate 132 of brace member 60, the horizontal end portions of brace 60 being connected by a vertical bar 134. The sprockets are mounted for rotation on stub shafts which are cantilever mounted in and secured to transverse brace member 64.

Figure 5:
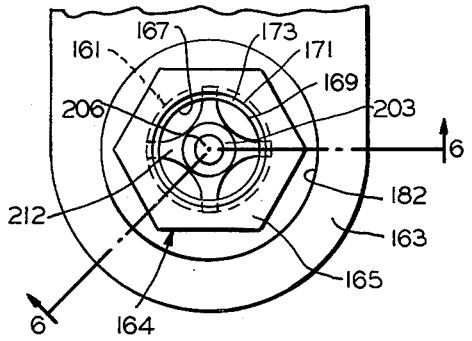
FIG. 5 is a partial plan view of the coupling of the present invention with certain parts broken away.
Figure 6:
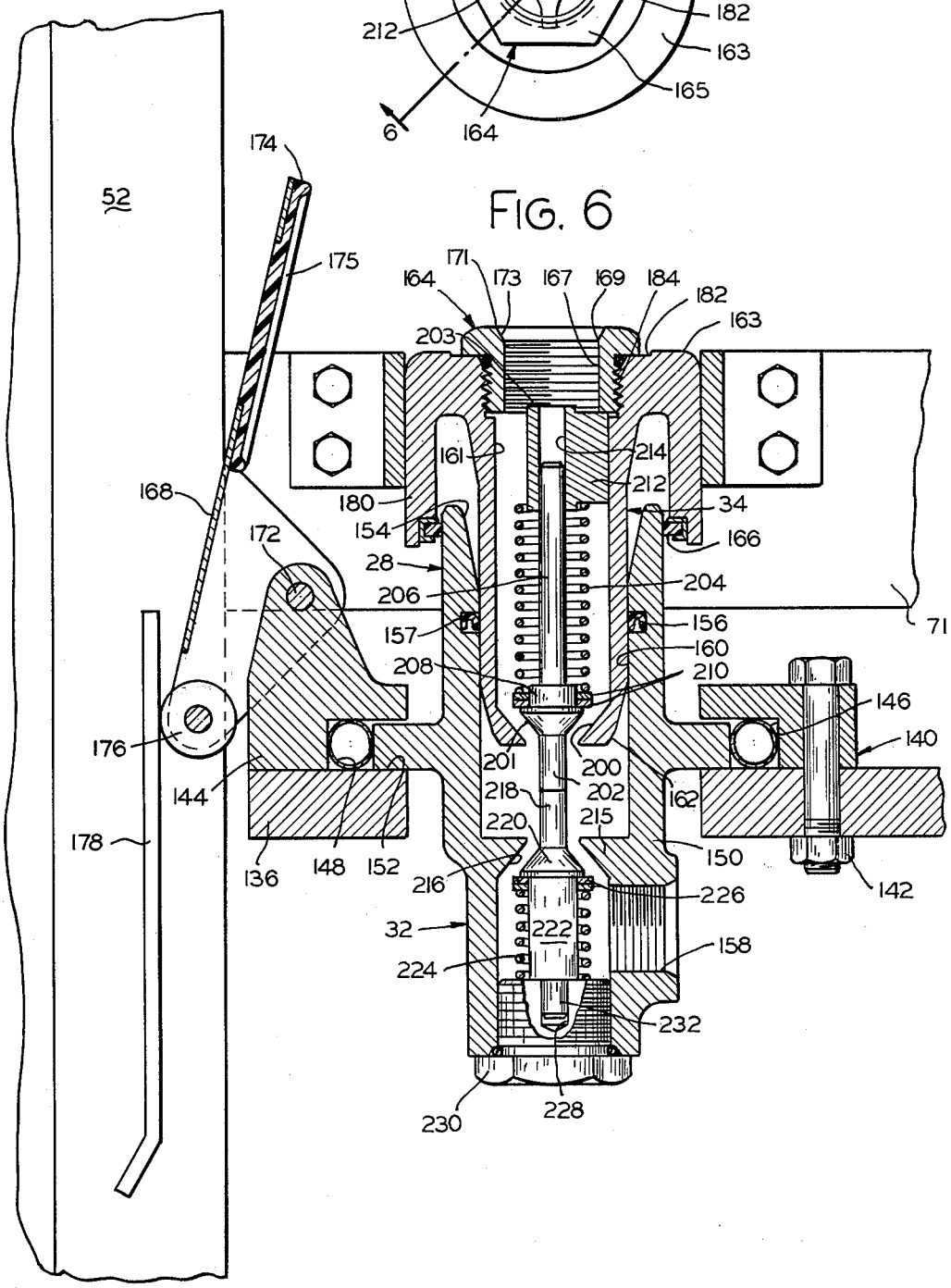
FIG. 6 is an enlarged vertical sectional view of the hydraulic coupling shown in an engaged position taken along line 6—6 in FIG. 5.
Figure 7:
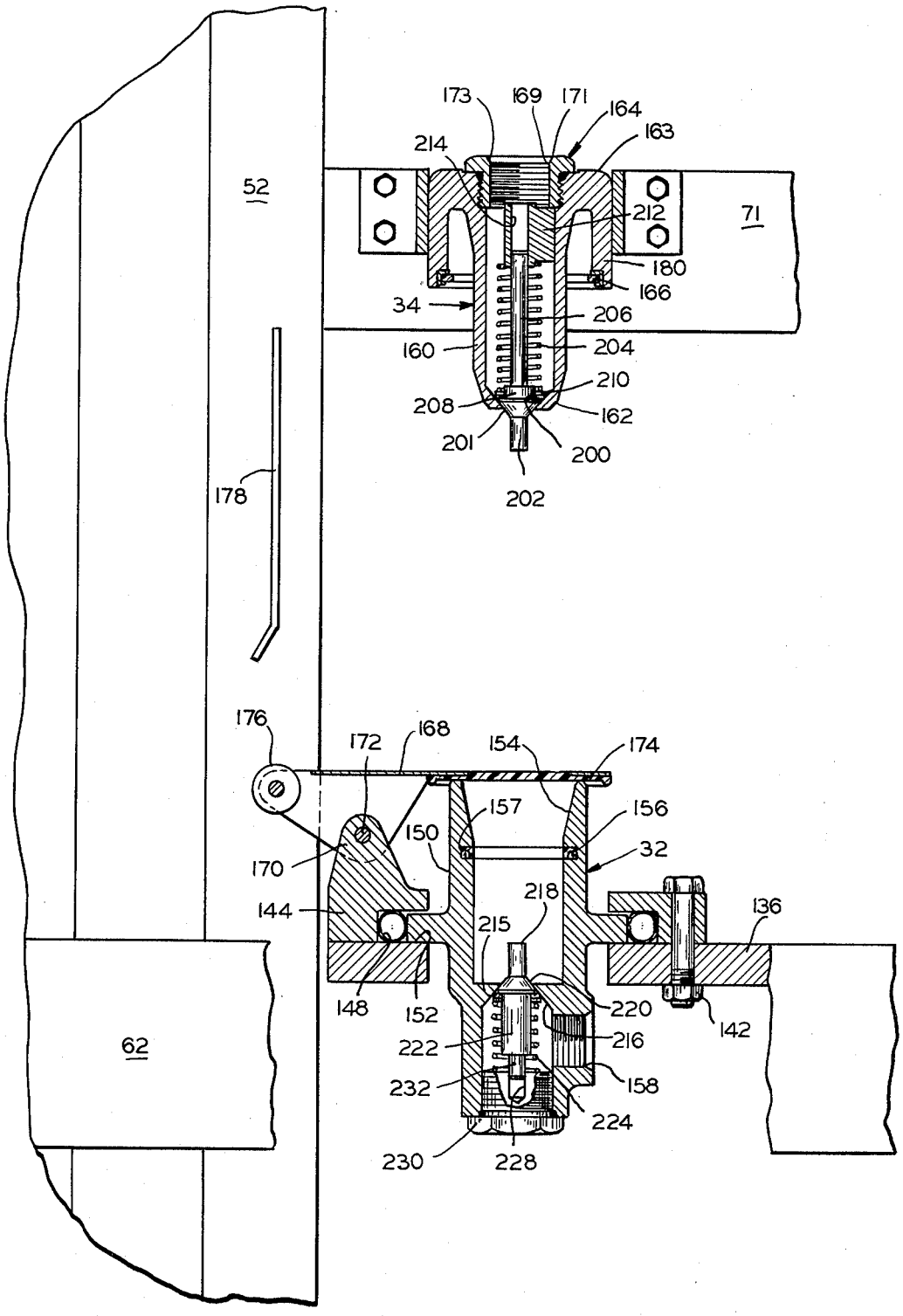
FIG. 7 shows the coupling of FIG. 6 in a disengaged position.

As shown in FIGS. 5, 6 and 7 the first valve assembly 34 is connected to the intermediate transverse member 71 of innermost mast section 50. The first valve 34 includes a hollow tubular portion 160 tapered at its lower end 162 and having in its top surface 163 a port 164. Port 164 has a threaded housing 165 with a port opening 167 having an inner diameter 169, an outer diameter 171, and a chamfer 173, there between. Top surface 163 of tubular portion 160 has a circular indentation 182 and an opening 184 through which port 164 is threadably inserted. Tubular portion 160 has an inner wall 161 which has at its lower end 162 an inner frustro-conical shaped surface 200 for engagement with the upper frustro-conical shaped portion 201 of valve stem 202. Plunger 206 is integrally connected at its lower end to stem block 208 which is integrally connected to the upper portion 201 of valve stem 202. Washers 210 and cross-shaped guide 212, which has an upper rim 203, are spaced apart by a spring 204. Plunger 206 is internally threaded through spring 204 and is inserted through bore 214 in guide 212. When upper portion 201 of stem 202 is in seated engagement with the frustro-conical inner surface 200 of the lower end 162 of hollow tubular member portion 160, primary cylinder 18 is not in fluid communication with the hydraulic fluid reservoir.

Second valve 32 of coupling 28 is attached to an extension plate 136 of brace member 62 by self-centering device 140 which includes a nut and bolt assembly 142, a retainer ring 144 having an inner cavity 146, and a circular endless spiral spring member 148 provided in the inner cavity 146. Hollow cylindrical housing 150 of second valve member 32 has an outer flange 152 partially received in the inner cavity 146 of self-centering device 140 and is bias mounted by spring 148 in the retainer ring 144 of self-centering device 140. Tapered portions 154 of the upper inner peripheral surface of hollow cylindrical housing 150 combines with the self-centering device 140 to allow the lower tapered end 162 of first valve member 34 to register in fluid communication with the second valve member 32 even though the valves are not in exact alignment. A high pressure U-shaped seal 156 provided in a circumferential recess 157 in the inner surface of cylindrical housing 150 of second valve 32 prevents undesired fluid leakage when the coupling members are in fluid engagement. A dirt seal 166 is provided in the upper curled lip portion 180 of first valve 34 to prevent hydraulic fluid contamination.

Second valve 32 includes an inwardly projecting circular flange 215 from the inner surface of housing 150 which has a frustro-conical surface 216. A stem 218 has a lower frustro-conical portion 220 in selective seated engagement with the inside surface 216 of inner flange 215 of tubular housing 150. Integrally connected to the bottom of stem 218 is a cylindrical rod 222 internally threaded through a spring 224 which is retained between upper washers 226 and a plug 230 which has an internal bore 228 to receive a downwardly directed vertical plunger 232 internally connected to rod 222. The spring 224 acts to bias the lower portion 220 of valve stem 218 into seated fluid blocking engagement with the inner surface 216 of flange 215. When first valve 34 and second valve 32 are in their FIG. 6 engaged positions both valve stems 218 and 202 are unseated and allow fluid communication between port 164 in the first valve 34 and a port 158 in the second valve 32. When the valves 34 and 32 are removed from their FIG. 6 position, valve stems 202 and 218 by the action of their respective springs 204 and 224 are returned to their respective seated position shown in FIG. 7.

It should be noted that after first valve member 34 is retracted from fluid engagement with second valve member 32 a pool of hydraulic fluid remains trapped in the interior of tubular housing 150. To protect this pool of fluid from contamination from impurities, a cover plate 168 is pivotally connected at one end to a raised portion 170 of retainer ring 144 at 172. The other end 174 of the cover plate overlies the open end of valve assembly 32 when the innermost upright section 50 is raised from its fully lowered position shown in FIG. 2. The overlying end 174 of cover plate 168 has a cap portion 175 which seals the second valve 32 from contamination when the cover plate is in its FIG. 7 position.

The cover plate 168 includes a roller 176 mounted for rotational movement on the one end of cover 168 and engageable with a camming surface actuator 178 connected with the innermost upright section 50. The lower end of the camming surface actuator 178 is spaced below the lower end 162 of the first valve 34 and engages the roller 176 to swing the cover plate 168 upward and away from the second valve 32 when the innermost mast section 50 is fully retracted.

Figure 4:
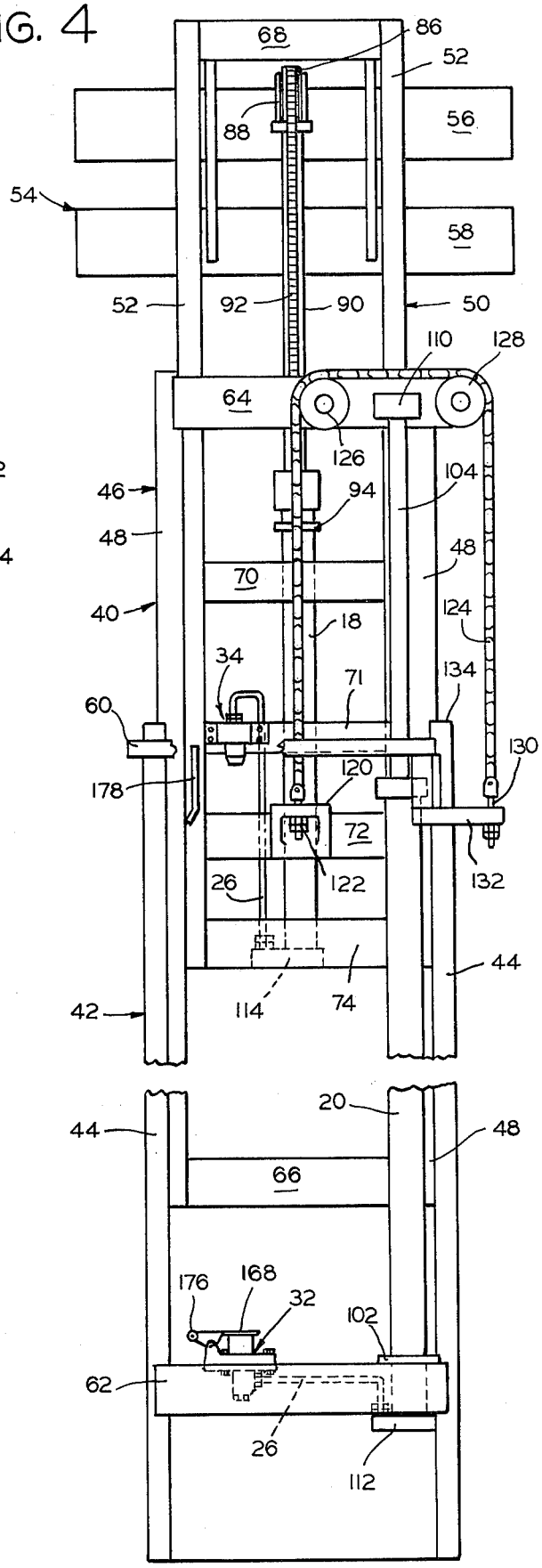
FIG. 4 is a rear elevational view similar to FIG. 3 showing the upright of FIG. 2 in a partially extended position with certain parts broken away to reveal details of construction.

In operation, to elevate the upright 40 from the position shown in FIG. 2 to that in FIG. 4, hydraulic fluid is delivered simultaneously to both fluid actuator assemblies and, as is well known, the primary and secondary cylinders operate automatically in a sequence related to the pressure differential in the cylinders whereby the primary cylinder 18 functions to elevate load carriage 54 to the full free-lift position illustrated in FIG. 3. At the termination of this initial stage of operation the hydraulic fluid automatically sequences secondary cylinder 20 to elevate the entire telescopic upright structure in known manner and as shown in FIG. 4 while the load carriage is maintained by cylinder 18 in the aforementioned free-lift position.

When the load or fork carriage 54 is in a free-lift position and the secondary cylinder 20 is initially extended the valve assemblies or coupling members 32 and 34 are separated as in FIGS. 4 and 7 and assume a fluid blocking or no-flow position. As shown in FIG. 3 when the load carrier is in its free-lift position, the roller 176 of the cover plate 168 is in engagement with the camming surface plate 178 attached to the left I-beam rail 52. When the secondary cylinder begins to extend, the camming surface actuator 178 moves upwardly away from the roller 176 and consequently the cover plate pivots at 172 to assume a horizontal overlying position above the second valve 32 of coupling 28 to protect it and the pool of hydraulic fluid above flange 215 from foreign elements such as dirt and grease when the coupling members are disengaged.

Lowering of the upright is effected by actuating the control valve 16 to vent the secondary cylinder to the fluid reservoir, whereby a reversal of the above-mentioned sequence occurs as cylinder assembly 20 first fully retracts from the position shown in FIG. 4 to the FIG. 3 position, where the camming surface actuator 178 again engages roller 176 of cover plate 168 to swing the cover plate upwardly away from the second valve 32 so that first valve 34 can again engage second valve 32 to establish fluid communication.

As will now be apparent to persons skilled in the art, my invention provides much improved operator visibility through lift truck uprights and the like by eliminating, or at least minimizing, the previous requirement for flexible hose and the reeving thereof in the upright.

Although only one embodiment of my invention has been described herein, this disclosure is merely for the purpose of illustration and not as a limitation of the scope of the invention. It is therefore to be expressly understood that the invention is not limited to the specific embodiment shown, but may be used in various other ways, and that various modifications may be made to suit the different requirements, and that other changes, substitutions, additions, and omissions may be made in the construction, arrangement, and manner of operation of the parts without necessarily departing from the scope of the invention as defined in the following claims.

What is claimed is:

1. In combination:

a first fluid actuated assembly;

a second fluid actuated assembly for outwardly extending and retracting said first fluid actuated assembly;

a fluid conduit adapted to connect said first and second fluid actuated assemblies, said conduit having a first portion and a second portion;

a first valve in said first portion of said conduit operatively connected with said first fluid actuated assembly; and a second valve in said second portion of said conduit operatively connected with said second fluid actuated assembly;

said first valve being extended with said first fluid actuated assembly to a selected position so that it is in spaced relation to said second valve without connection thereto of any kind;

said first and second valves being disengaged when said first fluid actuated assembly is extended relative to said second fluid actuated assembly, and said first and second valves being reengaged to form a continuous conduit of said first and second conduit portions when said first fluid actuated assembly is retracted relative to said second fluid actuated assembly and wherein said first and second valves are constructed to permit fluid flow therethrough when said valves are in operative contact and to interrupt such fluid flow when said valves are out of operative contact and wherein said first and second valves each include a housing section having a cavity for containing fluid, each of said housing cavities having an outer end, said first and second valves each including an outward projection spring biased in an outward direction, said respective outward projections having an inner end and an outer end, said outer ends of respective outward projections capable of contact with one another to provide said operative contact, and said inner ends of said respective outward projections blocking fluid flow through said housing cavities when said outer ends of respective outward projections are out of said operative contact.

2. The invention as claimed in claim 1 further comprising means for covering said second valve when said first fluid actuated assembly is extended relative to said second fluid actuated assembly.

3. The invention as claimed in claim 1 wherein means is connected to at least one of said valves for aligning said first and second valves during reengagement thereof when said first fluid actuated assembly is retracted relative to said second fluid actuated assembly.

4. In combination:

a first member;

a second member slidably connected with said first member;

a third member slidably connected with said second member;

a first fluid actuated extensible assembly for extending said third member longitudinally of said second member;

a second fluid actuated extensible assembly for extending said second member with said first actuator assembly and said third member longitudinally of said first member;

a fluid conduit adapted to connect said first and second fluid actuated assemblies, said conduit having a first portion and a second portion;

a first valve in said first portion of said conduit operatively connected with said first fluid actuated assembly; and a second valve in said second portion of said conduit operatively connected with said second fluid actuated assembly;

said first valve being extended with said second member to a selected position so that it is in spaced relation to said second valve without connection thereto of any kind;

said first and second valves being disengaged when said second fluid actuated cylinder assembly extends said second member longitudinally of said first member, and said first and second valves being reengaged to form a continuous conduit of said first and second conduit portions between said primary and secondary fluid actuated assemblies when said second member is retracted relative to said first member.

5. An upright for a lift truck comprising:

a fixed section;

a telescopic section slidably connected with said first member;

a load carrier slidably connected with said telescopic section;

a first fluid actuated cylinder assembly for extending said load carrier longitudinally of said telescopic section;

a second fluid actuated cylinder assembly for extending said telescopic section with said first cylinder assembly and said load carrier longitudinally of said fixed section;

a fluid conduit adapted to connect said first and second cylinder assemblies, said conduit having a first portion and a second portion;

a first valve in said first portion of said conduit operatively connected with said first fluid actuated assembly; and a second valve in said second portion of said conduit operatively connected with said second cylinder assembly;

said first valve being extended with said telescopic section to a selected position so that it is in spaced relation to said second valve without connection thereto of any kind whereby unobstructed visibility is provided through the upright;

said first and second valves being disengaged when said second cylinder assembly extends said telescopic section longitudinally of said fixed section, and said first and second valves being reengaged to form a continuous conduit of said first and second conduit portions between said primary and secondary cylinder assemblies when said telescopic section is retracted relative to said fixed section.

6. An upright as claimed in claim 5 further comprising means for covering said second valve when said primary cylinder assembly is extended outwardly by said secondary cylinder assembly.

7. An upright as claimed in claim 6 wherein said covering means includes a cover plate pivotably mounted to said fixed section, said cover plate overlying said second valve when said secondary cylinder assembly extends said telescopic section outwardly of said fixed section, an element operatively connected to said telescopic section and engageable with said cover plate to pivot the cover plate away from said second valve when said telescopic section is retracted relative to said fixed section and prior to reengagement of said first and second valves.

8. An upright as claimed in claim 5 wherein means is connected to at least one of said valves for aligning said first and second valves during reengagement thereof when said telescopic section is retracted longitudinally of said fixed section.

9. An upright as claimed in claim 8 wherein said aligning means includes a tapered end of at least one of said valves and a flexible connection between one of said valves and the adjacent upright section.

10. An upright as claimed in claim 5 further comprising an intermediate telescopic section supported by and extensible relative to said fixed section, said first mentioned telescopic section extensible relative to said intermediate section, said secondary cylinder assembly operatively connected to said intermediate telescopic section for extending and retracting said intermediate telescopic section longitudinally of said fixed section.

11. An upright as claimed in claim 10 wherein said upright is in a full free-lift position when said load carrier is fully extended and said first mentioned and said intermediate telescopic sections are fully retracted, said valves being disengaged when said telescopic sections initially move to extend from said full free-lift position, and said valves being reengaged when said telescopic sections are fully retracted with said load carrier in said full free-lift position.

12. An upright as claimed in claim 10 wherein said fixed section includes a cross piece and said first mentioned telescopic section includes a cross piece, said first valve being mounted on said fixed section cross piece and said second valve being mounted on said first mentioned telescopic section cross piece.

13. The invention as claimed in claims 4, 5, 6 or 8 wherein said first and second valves are constructed to permit fluid flow therethrough when said valves are in operative contact and to interrupt such fluid flow when said valves are out of operative contact.

14. The invention as claimed in claim 13 wherein said first and second valves each include an outward projection, said outward projections capable of contact with one another to provide said operative contact.

15. The invention as claimed in claim 14 wherein each of said valves includes a housing section having a cavity for containing fluid, said respective housing sections in fluid communication when said outward projections are in said operative contact, and said respective outward projections blocking fluid flow between respective housing sections when said outward projections are out of said operative contact.

16. The invention as claimed in claim 13 wherein said first and second valves each include a housing section having a cavity for containing fluid, each of said housing cavities having an outer end, said first and second valves each including a stem spring biased in an outward direction, said respective stems having an inner end and an outer end, said outer ends of respective stems capable of contact with one another to provide said operative contact, and said inner ends of said respective stems blocking fluid flow through said housing cavities when said outer ends of respective stems are out of said operative contact.

* * * * *